US010184616B2

(12) United States Patent
Tousain

(10) Patent No.: US 10,184,616 B2
(45) Date of Patent: Jan. 22, 2019

(54) ELONGATED LIGHTING DEVICE WITH ADHESIVELY AFFIXED REFLECTOR AND LIGHTING ELEMENT CARRIER, AND METHOD OF ASSEMBLY

(71) Applicant: PHILIPS LIGHTING HOLDING B.V., Eindhoven (NL)

(72) Inventor: Robertus Leonardus Tousain, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 13 days.

(21) Appl. No.: 15/328,393

(22) PCT Filed: Jul. 10, 2015

(86) PCT No.: PCT/EP2015/065810

§ 371 (c)(1),
(2) Date: Jan. 23, 2017

(87) PCT Pub. No.: WO2016/012271

PCT Pub. Date: Jan. 28, 2016

(65) Prior Publication Data

US 2017/0211751 A1 Jul. 27, 2017

(30) Foreign Application Priority Data

Jul. 23, 2014 (WO) ..... PCT/CN2014/082796
Aug. 1, 2014 (EP) ..... 14179439

(51) Int. Cl.
*F21S 4/20* (2016.01)
*F21K 9/27* (2016.01)
(Continued)

(52) U.S. Cl.
CPC ..... *F21K 9/27* (2016.08); *F21K 9/68* (2016.08); *F21K 9/90* (2013.01); *F21V 7/005* (2013.01);
(Continued)

(58) Field of Classification Search
CPC ..... F21S 4/28; F21S 4/20; F21K 9/27; F21K 9/237; F21K 9/275; F21Y 2103/10
See application file for complete search history.

(56) References Cited

U.S. PATENT DOCUMENTS 6,582,103 B1 * 6/2003 Popovich ..... F21V 5/02 361/224
7,114,830 B2 * 10/2006 Robertson ..... F21V 7/005 362/240
9,041,023 B2 * 5/2015 Satake ..... F21V 17/10 257/88
9,146,017 B2 * 9/2015 Van Der Wel ..... F21V 3/06
(Continued)

FOREIGN PATENT DOCUMENTS

CN 202812926 U 3/2013
EP 1913857 A1 4/2008
(Continued)

*Primary Examiner* — Ismael Negron
(74) *Attorney, Agent, or Firm* — Akarsh P. Belagodu

(57) ABSTRACT

A lighting device includes an elongate housing with a light exit window, a carrier assembly disposed within the housing and having a plurality of SSL elements, a reflector having a plurality of apertures and positioned between the housing and the carrier assembly, and an adhesive extending through the apertures and fixing the carrier assembly and the reflector to the housing. A method of assembling the lighting device and of a luminaire-including the lighting device are also disclosed.

15 Claims, 2 Drawing Sheets

(51) Int. Cl.

| | |
|---|---|
| ***F21K 9/90*** | (2016.01) |
| ***F21V 7/00*** | (2006.01) |
| ***F21V 7/22*** | (2018.01) |
| ***F21V 17/10*** | (2006.01) |
| ***F21V 19/00*** | (2006.01) |
| ***F21V 29/507*** | (2015.01) |
| ***F21K 9/68*** | (2016.01) |
| *F21V 7/04* | (2006.01) |
| *F21Y 103/10* | (2016.01) |
| *F21Y 115/10* | (2016.01) |
| *F21V 29/70* | (2015.01) |

(52) U.S. Cl.

CPC ..... *F21V 7/22* (2013.01); *F21V 17/101* (2013.01); *F21V 19/005* (2013.01); *F21V 19/0035* (2013.01); *F21V 29/507* (2015.01); *F21V 7/041* (2013.01); *F21V 29/70* (2015.01); *F21Y 2103/10* (2016.08); *F21Y 2115/10* (2016.08)

(56) References Cited

U.S. PATENT DOCUMENTS

| | | | | |
|---|---|---|---|---|
| 9,209,353 | B2 * | 12/2015 | Radermacher | F21K 9/00 |
| 9,541,274 | B2 * | 1/2017 | Bertram | F21V 23/02 |
| 9,551,480 | B2 * | 1/2017 | Speer | F21K 9/27 |
| 9,618,168 | B1 * | 4/2017 | Jiang | F21V 3/061 |
| 9,810,384 | B2 * | 11/2017 | Yingchun | F21V 23/06 |
| 9,920,887 | B2 * | 3/2018 | Van Delden | F21K 9/27 |
| 2012/0069556 | A1 | 3/2012 | Bertram et al. | |
| 2013/0033888 | A1 | 2/2013 | Van Der Wel et al. | |
| 2016/0084449 | A1 * | 3/2016 | Speer | F21V 19/0025 362/223 |
| 2016/0327215 | A1 * | 11/2016 | Rijken | F21K 9/27 |
| 2017/0307146 | A1 * | 10/2017 | Wang | F21V 29/70 |

FOREIGN PATENT DOCUMENTS

| | | | |
|---|---|---|---|
| KR | 20100057340 | A | 5/2010 |
| WO | WO2010136333 | A1 | 12/2010 |
| WO | WO2011086906 | A1 | 7/2011 |
| WO | 2013057660 | A2 | 4/2013 |
| WO | WO2013179227 | A2 | 12/2013 |

* cited by examiner

ELONGATED LIGHTING DEVICE WITH ADHESIVELY AFFIXED REFLECTOR AND LIGHTING ELEMENT CARRIER, AND METHOD OF ASSEMBLY

CROSS-REFERENCE TO PRIOR APPLICATIONS

This application is the U.S. National Phase application under 35 U.S.C. § 371 of International Application No. PCT/EP2015/065810, filed on Jul. 10, 2015, which claims the benefit of European Patent Application No. 14179439.6, filed on Aug. 1, 2014 and Chinese Patent Application No. PCT/CN2014/082796, filed on Jul. 23, 2014. These applications are hereby incorporated by reference herein.

FIELD OF THE INVENTION

The present invention relates to a lighting device, in particular to a lighting device comprising Solid State Lighting (SSL) elements.

The present invention also relates to a method of assembling the lighting device and to a luminaire comprising the lighting device.

BACKGROUND OF THE INVENTION

With a continuously growing population, it is becoming increasingly difficult to meet the world's energy needs and, simultaneously, to control carbon emissions to kerb greenhouse gas emissions which are considered responsible for global warming phenomena. These concerns have triggered a drive towards a more efficient use of electricity in an attempt to reduce energy consumption.

One such area of concern is lighting applications, either in domestic or commercial settings. There is a clear trend towards the replacement of traditional, relatively energy-inefficient, light bulbs such as incandescent or fluorescent light bulbs with more energy efficient replacements. Indeed, in many jurisdictions the production and retailing of incandescent light bulbs has been outlawed, thus forcing consumers to buy energy-efficient alternatives, e.g. when replacing incandescent light bulbs.

A particularly promising alternative is provided by solid state lighting (SSL) devices, which can produce a corresponding luminous output at a fraction of the energy cost of incandescent or fluorescent light bulbs. An example of such a SSL element is a light emitting diode (LED).

It is known to provide SSL lighting devices having a similar overall shape to fluorescent light tubes, i.e. tubular solid state lighting devices. Such devices can provide a form factor that is comparable with traditional lighting devices, this can aid market penetration as customers may like or be accustomed to the form factors of such fluorescent light tubes. These tubular SSL devices may be used to replace fluorescent light tubes or used in similar applications to fluorescent light tubes. In particular, these SSL lighting devices may be particularly easy to retro-fit in place of fluorescent light tubes.

An example of a prior art tubular SSL element-based lighting device comprises a tubular housing, within the tubular housing is a printed circuit board onto which a plurality of LED elements are mounted at regular intervals. In this known low-cost construction, the printed circuit board (PCB) is directly attached to the tubular housing using adhesive. However, this results in a very wide beam angle, which can be undesired. It is also known to provide a metal reflector for beam shaping between the PCB and the tubular body, however, the cost of this reflector may be high and the complexity of assembly of the lighting device is increased, which results in an overall more expensive device.

SUMMARY OF THE INVENTION

The invention seeks to provide a lighting device that can have a narrow beam and can be assembled in a straightforward and, therefore, cost-effective manner.

The invention provides a lighting device comprising an elongate housing having a light exit window; a carrier assembly within the housing comprising a plurality of SSL elements; a reflector between the housing and the carrier assembly, having a plurality of apertures between the housing and the carrier assembly; and an adhesive affixing the reflector to the housing, the adhesive also extending through the apertures and further affixing the carrier assembly to the housing.

Such a lighting device can be assembled in a relatively economic manner. In particular, in assembling such a lighting device it is not necessary to separately apply adhesive to the carrier assembly and the reflector, accordingly, the number of steps involved in such assembly may be reduced. This advantage may also be obtained using an automated manufacturing process. As a result of these factors, the lighting device may be provided in a particularly economic way.

Further, the device may have a form factor that is comparable with traditional fluorescent light tubes, which may aid market penetration. For example, the lighting device may be a tubular lighting device having a tubular elongate housing.

The housing may be of glass. Use of a glass housing may be particularly economic. Further, glass housings may provide sufficient rigidity to enable the construction of lighting devices of some length without the need for additional structural elements beyond such a glass housing. Further, glass may be handled using techniques familiar to those working in the field of lighting devices.

The reflector may be dimensioned to reflect light emitted by said SSL elements under emission angles within a first range.

Accordingly, light may not directly exit the lighting device within said first range, instead the light is reflected. This can provide a lighting device having a relatively narrower beam. Lighting devices having a narrower beam may be advantageous in particular lighting applications. Further, as a greater proportion of the light emitted by the SSL elements may be provided in a desired area or location the effective luminous efficiency of the lighting device may be increased.

The first range may be 100° or more. For example, 100°, 120°, 140°, 160°, 180°, 200°, 220° or more.

This may provide a beam angle of 260° or less. For example a beam angle of less than 260°, less than 240°, less than 220°, less than 200°, less than 180°, less than 160° or less than 140°.

Each of the plurality of apertures may have a regular shape, for example, rectangular, square or circular. This can help to provide a known, e.g. good, quality of attachment of the carrier assembly to the housing. Further, this can help to provide a known, e.g. relatively large, structural integrity to the reflector.

The plurality of apertures may form a regular array. This can also help to provide a known quality of attachment of the carrier assembly to the housing and/or to provide a known structural integrity to the reflector.

The reflector may be a foil or a paper. Such reflectors may be particularly economic.

The reflector may comprise a plastics material.

The reflector may comprise sheet metal.

The reflector may comprise a reflective coating. For example, the reflector may comprise a plastics material, which is not reflective, coated with a reflective coating.

At least a portion of the carrier assembly may be shaped to match the inner surface of the housing. This can enable the carrier assembly to have a particularly good attachment to the inner surface of the housing. Further, this can enable economic use of the adhesive.

At least a portion of the reflector may be shaped to match the inner surface of the housing. For example, the reflector may be shaped by the inner surface of the housing and a portion of the carrier assembly when the lighting device is assembled. This can enable particularly good attachment of the reflector and the carrier assembly to the housing. Further, this can also enable economic use of adhesive.

The carrier assembly may comprise a printed circuit board (PCB) and/or a heat sink. For example, the carrier assembly may be a PCB, or the carrier assembly may be a PCB mounted on a heat sink.

The invention also provides a method of assembling a lighting device comprising providing a carrier assembly comprising a plurality of SSL elements; providing a reflector having a plurality of apertures therein; applying adhesive to the carrier assembly and/or the reflector; and forcing the carrier assembly and a housing together to affix the carrier assembly and the reflector to the housing, wherein the reflector is between the carrier assembly and the housing; the apertures of the reflector are between the housing and the carrier assembly; and the adhesive is forced through the apertures to affix the carrier assembly to the housing.

As discussed above, in relation to the lighting device, such a method may be particularly simple and easy to carry out, consequently the method may provide lighting devices cost-effectively. In particular, the number of assembly steps can be reduced as it is not necessary to separately apply adhesive to the carrier assembly and the reflector. This advantage may also be obtained using an automated manufacturing process and, further, as the method is less complex the method may be easier to automate. Easier automation may allow for a decrease the cost of machinery required for automation and therefore a further decrease the cost of lighting devices provided by the method.

The reflector may be placed on the carrier assembly before the adhesive is applied. This can enable adhesive to be applied to the reflector and carrier assembly simultaneously, as the adhesive may be applied to the carrier assembly through the apertures of the reflector. This can enable further simplification of the method of assembling the lighting device and, consequently, may be particularly economic.

The invention also provides a luminaire comprising the lighting device as described above. Because, as described above, the lighting device may be provided in a particularly cost-effective way, the luminaire comprising the lighting device may also be provided in a particularly cost-effective way.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
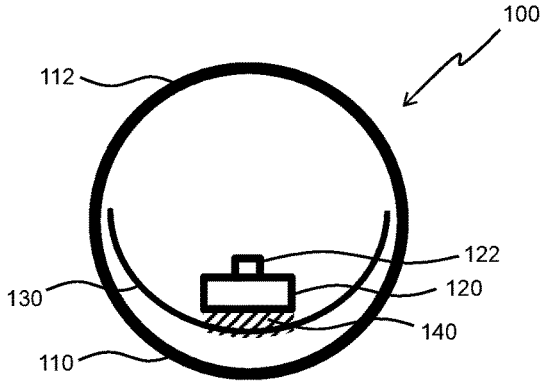
FIG. 1 depicts a schematic cross-section of a partially assembled lighting device according to an embodiment of the present invention.

It should be understood that the Figures are merely schematic and are not drawn to scale. It should also be understood that the same reference numerals are used throughout the Figures to indicate the same or similar parts.

Embodiments of the present invention are concerned with SSL element-based lighting devices. An area identified for improvement in the provision of SSL element based lighting devices is ease of construction. In particular, by providing SSL element-based lighting devices which are easier to fabricate it is desired to provide more cost-effective SSL devices.

Figure 3:
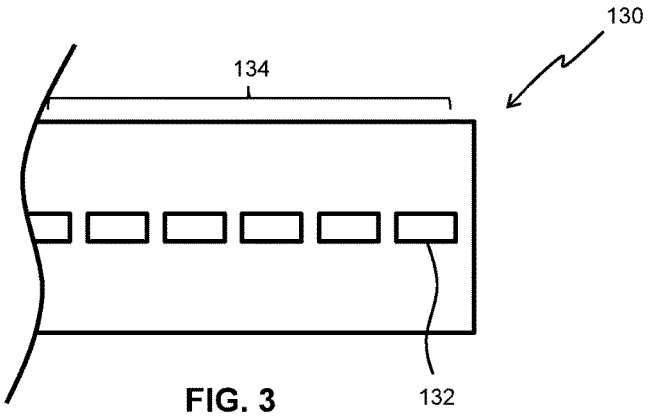
FIG. 3 depicts a schematic plan view of the reflector of the lighting device of FIG. 1.

Referring firstly to FIG. 1 of the accompanying drawings, a partially assembled lighting device 100 can be seen to comprise an elongate housing 110 (shown in cross-section perpendicular to the elongate axis) having a light exit window 112. There is a carrier assembly 120 within the housing 110 comprising a plurality of solid state lighting (SSL) elements 122. There is also a reflector 130 between the housing 110 and the carrier assembly 120. The reflector 130 has a plurality of apertures 132 (as shown in FIG. 3) between the housing 110 and the carrier assembly 120. An adhesive 140 is provided for fixing the reflector 130 to the housing 110; the adhesive 140 also extends through the apertures 132 for fixing the carrier assembly 120 to the housing 110.

Figure 2:
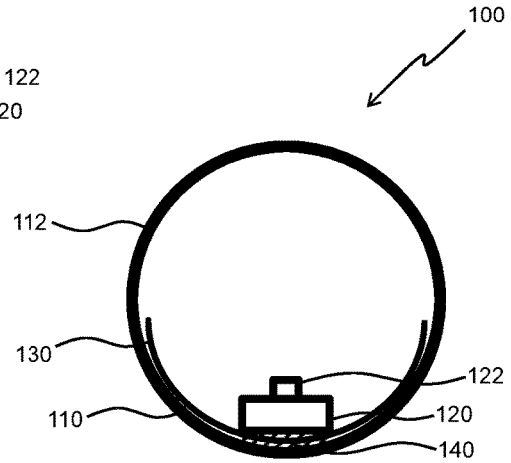
FIG. 2 depicts a schematic cross-section of the assembled lighting device of FIG. 1.

FIG. 2 shows the partially assembled lighting device 100 of FIG. 1 in an assembled state. It can be seen that the carrier assembly 120 and the housing 110 have been forced together, to affix the reflector 130 to the housing 110 and to affix the carrier assembly 120 to the housing 110 by the adhesive 140 extending through the apertures 132 of the reflector 130.

Accordingly, such a lighting device 100 can be assembled in a relatively cost-effective way. In particular, the carrier assembly 120 and reflector 130 can be affixed to the housing 110 in a simple way. In particular, it is not necessary to separately apply adhesive 140 to the carrier assembly 120 and the reflector 130, potentially resulting in a reduction in the number of steps required for assembly of the lighting device 100. Accordingly, the cost of assembling the lighting device 100, and consequently the lighting device itself 100, may be reduced. A reduction in the number of steps required for assembly may be particularly advantageous where the lighting device 100 is mass-produced, as any advantage may be obtained multiple times. Similarly, this advantage may be particularly prominent where the lighting device 100 is manufactured using an automated process, as in addition to reducing the number of steps required for assembly of the lighting device 100 the complexity of the machinery used to assemble the lighting device may also be reduced.

From the prior art it is known to affix a reflector between a housing and a carrier assembly, however this was done by affixing a carrier assembly to a reflector and separately affixing the carrier assembly and reflector to the housing. Such a process is more complex and as it involves separately applying adhesive to and affixing two pairs of components.

The adhesive 140 may be any suitable adhesive capable of affixing the carrier assembly 120, reflector 130 and housing 110 to one another. For example, an epoxy, or a hot melt adhesive. Other examples will be apparent to the skilled person.

In the context of the present specification, the fact that the adhesive 140 extends through the apertures 132 does not necessarily imply that the apertures 132 are completely filled with adhesive, e.g. there may be voids where adhesive is not present within the apertures 132. However, the adhesive may indeed completely fill the apertures 132.

In selected embodiments, the solid state lighting (SSL) elements 122 may be Light Emitting Diodes (LEDs). Each of the SSL elements 122 may emit light of the same colour; alternatively, the SSL elements 122 may be configured to emit light of differing colours in order to provide a desired effect, as is known to the skilled person. For instance, such colours may mix inside the housing to yield a luminous output of a desired colour.

The housing 100 may have any suitable size and shape. For instance, the housing 100 may be sized and shaped so as to be used to replace fluorescent light tubes, which may aid market penetration. For example, the lighting device may be a tubular lighting device having a tubular housing.

The housing 100 may be of glass. Glass is a material which may be available relatively cheaply. In particular, glass tubular bodies may be obtained at a lower cost than plastic tubular bodies. In some cases glass tubular bodies may cost as little as one tenth of the price of comparable plastic tubular bodies.

Further, glass housings may provide sufficient rigidity to enable the construction of lighting devices of some length without the need for additional structural elements beyond such a glass housing. Further, glass may be handled using techniques familiar to those working in the field of lighting devices.

Another benefit is that glass may have better heat dissipation capability than many plastics materials. Therefore, a glass housing 110 may form at least a part of a heat sink used to regulate the temperature of the SSL elements 122 in use. Accordingly, use of a glass housing 110 may mean that it is not necessary to provide a separate heat sink. Alternatively, where a separate heat sink is provided, the heat sink may be smaller, as glass housings may better participate in heat dissipation than many plastics housings. Omission of a discrete heat sink can make assembly of the lighting device simpler and more economic, and use of a smaller heat sink may be more economic.

Additionally, use of plastic housings beyond a certain length may require the use of additional structural elements to prevent the plastic tubular bodies from bending or sagging. However, as glass materials are generally less flexible than plastics materials, additional structural elements to prevent sagging may not be required for lighting devices longer than the above mentioned certain length. Further, fixing the carrier assembly and reflector as described above does not necessarily require substantial structural elements. Accordingly, the combination of fixing the carrier assembly and reflector as described above and the use of a glass housing may be used to particular advantage, in that this structure and material combination is particularly simple and additional structural elements may not be required, even for lighting devices longer than the above mentioned certain length. Therefore, this combination may be particularly economic or cost-effective.

The reflector 130 may be dimensioned to reflect light emitted by the SSL elements 122 under emission angles within a first range. Therefore, light emitted from the SSL elements 122 within the first range may not directly exit the lighting device 100. This can provide a lighting device having a narrower beam. Such lighting devices may be particularly advantageous in particular applications, for example, applications in which light is only required in particular areas or places, such as some office environments.

The first range may be 100° or more. For example, 100°, 120°, 140°, 160°, 180°, 200°, 220° or more. Of course, the first range may be any other suitable range as chosen by a skilled person.

This may provide a beam angle of 260° or less. For example a beam angle of less than 260°, less than 240°, less than 220°, less than 200°, less than 180°, less than 160° or less than 140°. By way of non-limiting example, the beam angle may be in a range from 140° to 260°.

The beam angle may be defined as the angle that links the two points where the radiation is 50% of the maximum radiation in the centre.

The beam angle provided may be chosen according to the application in which the lighting device is used, as will be familiar to the skilled person.

The carrier assembly 120 may be or comprise any structure which is capable of supporting the plurality of SSL elements as may be known to the person skilled in the art. By way of non-limiting example, the carrier assembly 120 may comprise at least one of a printed circuit board (PCB) and a heat sink. For example, the carrier assembly 120 may be a PCB, or the carrier assembly 120 may be a PCB mounted on a heat sink. A PCB is a convenient way of supplying electricity to the solid state lighting elements 122. The PCB may be of materials commonly used in the art and manufactured according to such procedures as are known to the skilled person. The heat sink may be of any suitable thermally conductive material as is known in the art, for example a metal such as aluminium.

The carrier assembly 120 may comprise additional components, for example, driver circuitry which may be included on a PCB. A heat sink may be used to prevent the components, such as SSL elements 122, from overheating. A heat sink may be particularly advantageous where the SSL elements 122 are high luminous output SSL elements, as will be familiar to the skilled person.

The lighting device 100 may additionally comprise other elements known to those skilled in the art. For example, the lighting device 100 may comprise electrical connectors for connecting the lighting device 100 to an electrical supply. Additionally or alternatively, the lighting device 100 may comprise diffusers for diffusing light emitted from the SSL elements 122 in order to provide a more uniform appearance if this is desired.

The lighting device 100 may further comprise a driver. The driver may be mounted on the carrier assembly 120. If a driver is not provided as part of the lighting device 100, then a driver may be provided as part of a luminaire or in some other way external to the lighting device 100.

The lighting device 100 may further comprise at least one cap. Such a cap may provide electrical connections between the SSL elements 122 and a power supply. For example, the cap may comprise connectors, such as pins, which connect to an electrical supply, e.g. an electrical supply of a fitting, such as a fitting of a luminaire.

FIG. 3 shows a reflector 130 which may be included in any embodiment of the present invention. As shown in FIG. 3, each of the plurality of apertures 132 may have a regular shape, for example, rectangular, square or circular. The apertures 132 illustrated in FIG. 3 are rectangular. Use of regular shaped apertures 132 can help to provide a known, e.g. good, quality of attachment between the carrier assembly 120 and the housing 110. In particular the shape and size of the adhesive 140 which extends through the apertures and fixes the carrier assembly 120 to the housing 110 can be known. Further, use of regularly shaped apertures 132 can help to provide a known, e.g. relatively large, structural integrity to the reflector 130.

Also as shown in FIG. 3, the plurality of apertures may form a regular array 134. This can also help to provide a known quality of attachment between the carrier assembly 120 and the housing 110. Further, a regular array 134 can help to provide a known structural integrity to the reflector 130. In FIG. 3 the regular array 134 is an array of rectangular apertures 132, however, any regular shaped apertures may form a regular array 134.

The reflector 130 may be a foil or a paper. Such reflectors 130 may be particularly economic. Alternatively, the reflector 130 may comprise a plastics material. As a further alternative, the reflector 130 may comprise sheet metal.

The reflector 130 may comprise a reflective coating. For example, the reflector 130 may comprise a plastics material, which is not reflective, coated with a reflective coating. Such reflectors 130 may be particularly economic as a relatively cheap plastics material may be used to construct the reflector.

Alternatively, the reflector 130 may be formed of any other suitable materials known to the person skilled in the art.

Figure 4:
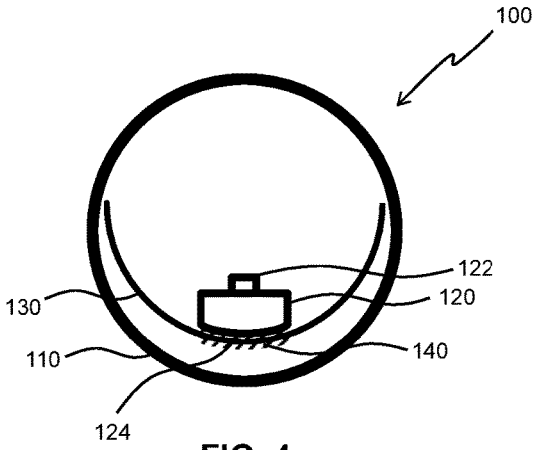
FIG. 4 depicts a schematic cross-section of a partially assembled lighting device according to another embodiment of the present invention.
Figure 5:
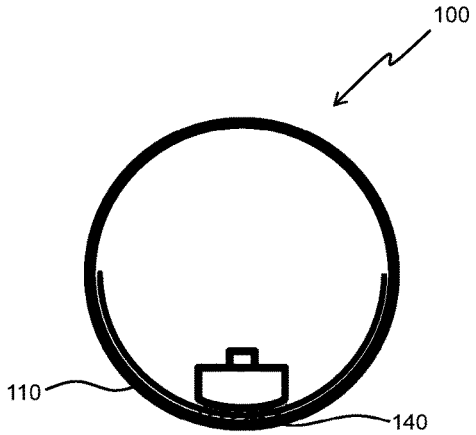
FIG. 5 depicts a schematic cross-section of the assembled lighting device of FIG. 4.

FIGS. 4 and 5 illustrate an alternative embodiment of a lighting device 100 according to the invention. As the embodiment illustrated in FIGS. 4 and 5 is substantially similar to that illustrated in FIGS. 1 and 2 only the differences will be described and like reference numerals are used.

As shown in the embodiment illustrated in FIGS. 4 and 5, a portion 124 of the carrier assembly 120 is shaped to match the inner surface of the housing 110. For example, the portion 124 may be an arcuate surface which mates with the housing 110. This can enable the carrier assembly 120 to have a particularly good attachment to the inner surface of the housing 110. Further, this can enable economic use of the adhesive 140, in particular, as the carrier assembly 120 is shaped to match the inner surface of the housing 110, less adhesive may be used to fill the void between the carrier assembly 120 and the housing 110 than if the carrier assembly 110 is not shaped so as to match the inner surface of the housing 110.

Additionally, at least a portion of the reflector 130 may be shaped to match the inner surface of the housing 110. For example, the reflector 130 may be shaped by the inner surface of the housing 110 and the portion 124 of the carrier assembly 120 when the lighting device is assembled, as shown in FIG. 4 or the reflector 130 may be shaped only by the inner surface of the housing 110 during assembly, as shown in FIG. 2.

Additionally, the good attachment between the carrier assembly 120, the reflector 130 and the housing 110 can provide good heat conductivity between the SSL elements 122, the carrier assembly 120, the reflector 130 and the housing 110 and hence good heat dissipation.

Embodiments of the invention also provide a method of assembling the lighting devices 100 described above. As shown in FIGS. 1 and 4, the method comprises providing a carrier assembly 120 comprising a plurality of SSL elements 122 and a reflector 130 having a plurality of apertures 132 therein. Adhesive 140 is applied to the carrier assembly 120 and/or the reflector 130. Then, as shown in FIGS. 2 and 5, the carrier assembly 120 and the housing 110 are forced together to affix the carrier assembly 120 and the reflector 130 to the housing 110. The reflector 130 is between the carrier assembly 120 and the housing 110 whilst the housing 110 and carrier assembly 110 are forced together. The apertures 132 of the reflector 130 are also between the housing 110 and the carrier assembly 120 and the adhesive 140 is forced through the apertures 132 to affix the carrier assembly 120 to the housing 110.

As discussed above, in relation to the lighting device 100, such a method may be particularly simple and easy to carry out; consequently the method may be cost-effective. In particular, it is not necessary to separately apply adhesive 140 to the carrier assembly 120 and the reflector 130, accordingly, the number of steps involved in such assembly may be reduced.

The reflector 130 may be placed on the carrier assembly 120 before the adhesive 140 is applied. This can enable adhesive to be applied to the reflector and carrier assembly simultaneously, as the adhesive may be applied to the carrier assembly through the apertures of the reflector. This can enable further simplification of the method of assembling the lighting device and, consequently, may be particularly economic.

The assembly of the lighting device 100 may comprise using a jig. For example, the carrier assembly 120 may be placed on a jig with the SSL elements 122 facing downwards. The reflector 130 may then be placed on the carrier assembly 120. The reflector 130 may be flat or, alternatively, pre-shaped to the form of the housing 110 or partially pre-shaped, for example with a curvature slightly less than the curvature of the housing. The adhesive 140 may then be applied to the carrier assembly 120 and reflector 130. The housing 110 may then be placed around the carrier assembly 120 and reflector 130. The jig may then be moved to force the carrier assembly 120 against the housing 110. Consequently, the reflector 130 is squeezed between the carrier assembly 120 and the housing 110. The adhesive 140 is forced through the apertures 132 to affix the carrier assembly 120 to the housing 110. The adhesive 140 may then be cured.

Figure 6:
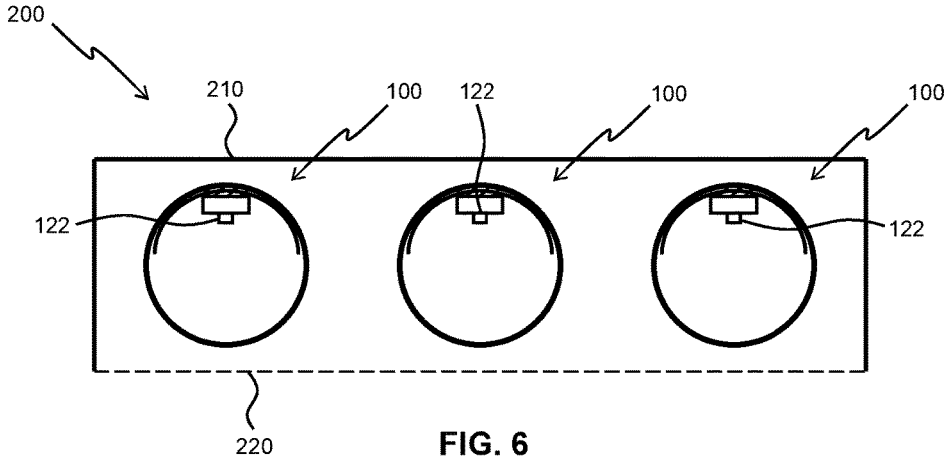
FIG. 6 depicts a schematic cross-section section of a luminaire according to an embodiment of the present invention.

As illustrated in FIG. 6, the lighting device 100 according to any embodiment of the invention may be advantageously included in a luminaire 200 such as a holder of the lighting device 100, e.g. a ceiling light fitting, an armature for fitting underneath a cabinet or the like, an apparatus into which the lighting device is integrated, e.g. a cooker hood or the like, and so on. FIG. 6 schematically depicts a luminaire 200 comprising a plurality of lighting devices 100 fitted in a housing 210 of the luminaire 200. The luminaire 200 comprises a light exit window 220. The light exit window 220 may comprise beam shapers such as one or more lens arrays, reflectors and so on. Alternatively, the light exit window 220 may simply be formed by an opening in the housing 210. The internal surfaces of the housing 210 may be reflective to reflect light that exits the lighting devices 100.

As illustrated in FIG. 6, the SSL elements 122 and the reflector of the lighting devices 100 may face the light exit window 220 of the luminaire 200. Alternatively, the lighting devices 100 may be mounted in the luminaire 200 such that the SSL elements 122 and reflectors face away from the light exit window 220. In such a case, the interior of the housing 210 of the luminaire 200 may be reflective. Consequently, the SSL elements 122 may not be directly visible to a user which may be desirable in certain applications, e.g. where glare is an issue.

The luminaire 200 including the lighting devices 100 may be capable of producing an appearance that is visually similar to the appearance produced by a luminaire comprising traditional fluorescent or phosphorescent light tubes. For example, the light exit window 220 of the luminaire 200 may be diffusive such that the SSL elements 122 and/or the lighting devices 100 are not individually perceptible to a user.

In a non-limiting example, the luminaires 200 may be ceiling armatures, e.g. armatures that are integrated in a suspended ceiling. Other examples of such luminaires 200 will be apparent to the skilled person.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising:

an elongate housing having a light exit window, a carrier assembly within the housing comprising a plurality of SSL elements;

a reflector between the housing and the carrier assembly, having a plurality of apertures between the housing and the carrier assembly; and an adhesive affixing the reflector to the housing, the adhesive also extending through the apertures and further affixing the carrier assembly to the housing.

2. A lighting device according to claim 1, wherein the housing comprises glass.

3. A lighting device according to claim 1, wherein the reflector is a foil or a paper.

4. A lighting device according to according to claim 1, wherein the reflector comprises a plastics material.

5. A lighting device according to claim 1, wherein the reflector comprises sheet metal.

6. A lighting device according to claim 1, wherein the reflector comprises a reflective coating.

7. A lighting device according to claim 1, wherein at least a portion of the carrier assembly is shaped to match the inner surface of the housing.

8. A lighting device according to claim 1, wherein the carrier assembly comprises at least one of a PCB and a heat sink.

9. A luminaire comprising the lighting device of claim 1 arranged within a housing.

10. A lighting device according to claim 1, wherein the reflector is dimensioned to reflect light emitted by said SSL elements under emission angles within a first range of 100° or more.

11. A lighting device according to claim 10, wherein the first range is 180° or more.

12. A lighting device according to claim 1, wherein each of the plurality of apertures has a regular shape.

13. A lighting device according to claim 12, wherein the plurality of apertures forms an array.

14. A method of assembling a lighting device, comprising:

providing a carrier assembly comprising a plurality of SSL elements;

providing a reflector having a plurality of apertures therein;

applying adhesive to at least one of the carrier assembly and the reflector; and forcing the carrier assembly and a housing together to affix the carrier assembly and the reflector to the housing, wherein the reflector is between the carrier assembly and the housing;

the apertures of the reflector are between the housing and the carrier assembly; and the adhesive is forced through the apertures to affix the carrier assembly to the housing.

15. The method according to claim 14, wherein the reflector is placed on the carrier assembly before the adhesive is applied.

* * * * *